US005996379A

United States Patent [19]

Skrippek

[11] Patent Number: 5,996,379

[45] Date of Patent: Dec. 7, 1999

[54] DRIVE DEVICE FOR A FRONT-LOADING WASHING MACHINE

[75] Inventor: Jörg Skrippek, Priort, Germany

[73] Assignee: BSH Bosch und Siemens Hausgeraete GmbH, Munich, Germany

[21] Appl. No.: 09/095,262

[22] Filed: Jun. 10, 1998

[30] Foreign Application Priority Data

Jun. 10, 1997 [DE] Germany ..... 197 24 475

[51] Int. Cl.[6] ..... D06F 37/30

[52] U.S. Cl. ..... 68/140

[58] Field of Search ..... 68/12, 16, 24, 68/140

[56] References Cited

U.S. PATENT DOCUMENTS

| | | | |
|---|---|---|---|
| 4,446,706 | 5/1984 | Hartwig | 68/24 |
| 5,809,809 | 9/1998 | Neumann | 68/140 |
| 5,862,686 | 1/1999 | Skrippek | 68/140 |

FOREIGN PATENT DOCUMENTS

| | | | |
|---|---|---|---|
| 1354594 | 1/1964 | France | 68/24 |
| 4157 | 7/1956 | Germany | 68/24 |
| 6411595 | 4/1965 | Netherlands | 68/140 |

*Primary Examiner*—Philip R. Coe
*Attorney, Agent, or Firm*—Herbert L. Lerner; Laurence A. Greenberg

[57] ABSTRACT

A front-loading washing machine includes a tub having a rear wall, an at least approximately horizontally disposed shaft, a laundry drum mounted overhung on the shaft, and a rigid supporting part fitted to the rear wall. A drive device for the washing machine includes a flat-type motor fitted to the rear wall for directly driving the shaft. The motor has a rotor formed entirely of magnetizable steel and a stator connected on the rigid supporting part or to the rear wall of the tub. The rotor has a hub encompassing and centrally fastened on an outer end of the shaft, a multiplicity of openings between the hub and a peripheral part, and a bell-like flange on the peripheral part pointing toward the tub. The stator has a central bearing sleeve for the shaft and for the hub and it has exciter windings. Laminate stacks are distributed on the stator for receiving the windings. The stacks are outwardly opposed by the flange with an air gap. The direct drive device for the drum provides good capability of cooling the windings with ambient air, so that the flat, slowly rotating motor cannot overheat during proper operation when dimensioned according to requirements. In addition, the motor can be fully preassembled at its manufacturer's plant.

18 Claims, 2 Drawing Sheets

DRIVE DEVICE FOR A FRONT-LOADING WASHING MACHINE

BACKGROUND OF THE INVENTION

Field of the Invention

The invention relates to a drive device for a front-loading washing machine having a laundry drum, the laundry drum is mounted overhung on an at least approximately horizontally disposed shaft within a bearing sleeve of a rigid supporting part fitted to a rear wall of a tub, and the laundry drum is directly driven by a flat-type motor which is likewise fitted to the rear wall of the tub.

Such drive devices are disclosed in German Published, Non-prosecuted Patent Applications DE 39 27 426 A1 and DE 43 41 832 A1, wherein the stator of the motor, which is constructed as a commutatorless external-rotor DC motor, is fastened directly on the bearing sleeve of the rigid supporting part. The shaft is mounted in the bearing sleeve and its outer end is connected in a torsionally resistant manner to the rotor of the motor. In that case, the rotor is a so-called external rotor which engages over the stator windings in the form of a pot and carries poles constructed as permanent magnets. In the automatic washing machine according to German Published, Non-prosecuted patent Application DE 43 41 832 A1, the motor is additionally surrounded by an insulating hood which damps noises radiated from the motor directly to the surrounding atmosphere.

The known drive devices encapsulate the stator, which is exposed to considerable temperature loading as a result of Joule heat in its windings, by a rotor configured in the form of a pot (and additionally by the sound-insulating hood in the case of German Published, Non-prosecuted patent Application DE 43 41 832 A1) to such a great extent that any cooling of the motor at all is lost. That is also reinforced primarily by the fact that such a direct-drive motor can scarcely cool itself by the rotating rotor due to its necessarily low intrinsic speeds of rotation. Therefore, in practice the known drive devices can be used only when they are protected against rapid overheating through the use of external cooling.

In addition, the known drive devices cannot be supplied to the washing machine manufacturer's plant as an already fully assembled motor. Their stators and rotors have to be delivered separately and assembled with one another for the first time at the washing machine factory. As a rule, special assembling equipment for completing motor assemblies is not present and is also not desired in a washing machine factory. Therefore, it is probable that the completion of the stator assembly, which is initially to be connected to the tub system, by the external rotor assembly will regularly only take place in an inaccurate manner. Extremely stringent requirements are made of the maintenance of a small air gap between the stator and rotor poles, with the air gap always being of the same size in each specimen, as far as possible. Stringent requirements are also made of the centered mounting, and those requirements cannot be satisfied in the case of the above-mentioned assembly in a washing machine factory. Therefore, in practice the known drive devices can only be used to a very limited extent.

SUMMARY OF THE INVENTION

It is accordingly an object of the invention to provide a drive device for a front-loading washing machine, which overcomes the hereinafore-mentioned disadvantages of the heretofore-known devices of this general type and in which on one hand, the cooling of stator windings by the ambient air can be readily ensured and the motor cannot overheat during proper operation when dimensioned in accordance with requirements, and on the other hand, the motor can be completed and tested at the motor manufacturer's plant before it is to be installed on the premises of a washing machine manufacturer.

With the foregoing and other objects in view there is provided, in accordance with the invention, in a front-loading washing machine including a tub having a rear wall, an at least approximately horizontally disposed shaft having an outer end, a laundry drum mounted overhung on the shaft, and a rigid supporting part fitted to the rear wall, a drive device for the washing machine, comprising a flat-type motor fitted to the rear wall of the tub for directly driving the shaft, the motor having a rotor formed entirely of magnetizable steel, and the motor having a stator connected on the rigid supporting part or instead to the rear wall of the tub; the rotor having a hub encompassing and centrally fastened on the outer end of the shaft, a peripheral part, a multiplicity of openings between the hub and the peripheral part, and a bell-like flange on the peripheral part pointing toward the tub; the stator having a central bearing sleeve for the shaft and for the hub, and the stator having exciter windings; laminate stacks distributed on the stator for receiving the exciter windings, the laminate stacks outwardly opposed by the bell-shaped flange defining an air gap.

Due to the inventive configuration with a multiplicity of openings, the motor acquires an open form of construction having heat-generating components, primarily the stator windings, which can be cooled from all sides by the ambient air. Even the low speed of rotation of the motor in the course of the washing operation is then still sufficient for the rotor to generate a heat-dissipating air movement. The completely steel construction of the rotor simplifies production enormously in comparison with the otherwise known "direct-drive motors" having special electrical laminate stacks and exciter windings. In addition, the heat dissipation is not disturbed by material interruptions or changes.

In this way, moreover, the motor can be completely assembled and tested at the motor supplier's plant, where the assembling and testing aids which are suitable therefor are available, thereby making it possible to supply the washing machine plant with motor assemblies which are always assembled with identical accuracy. In this case, the assembly can be mounted on the rear wall of the tub system instead of a cast supporting bracket which is otherwise customary at that location, or additionally thereto. For this purpose, the stator of the complete motor is fastened through the use of several screws to a number of points on the rear wall of the tub. The shaft of the laundry drum is then inserted from the front into the hub of the rotor, which is already connected to the stator through rolling bearings, and secured from behind with a central screw. These assembly procedures are very similar to those for fastening a supporting bracket and a belt pulley in accordance with conventional washing machine structures, so that the assembly personnel do not have to learn any completely different assembly procedures.

In accordance with another feature of the invention, parts of the rotor are constructed to assist an air movement arising in the course of its rotary movement. Therefore, the rotor can produce enough cooling air for the stator windings even with a slight rotary movement, for example at the washing speed of rotation. For this purpose, it is possible, for example, to use a spoke-like shaping of the rotor disk and a fan-like configuration of the spokes, or a rear side of the rotor bell which is provided with fanned shapings of perforations.

In accordance with a further feature of the invention, the motor is an electronically commutated DC motor, in which case the evolution of heat can, moreover, be kept at an extremely low level. Servicing is not necessary since there are no carbon brushes. The service life is limited only by possible bearing wear.

In accordance with an added feature of the invention, the motor is constructed as a so-called switched reluctance motor. In this case, the rotor is composed of a steel which is a relatively poor conductor in ferromagnetic terms. The structure of the stator is comparable with that of the electronically commutated DC motor. The particular advantage resides in a more cost-effective configuration of the rotor having no expensive magnetic materials.

In accordance with a concomitant feature of the invention, in order to facilitate assembly and lend it reproducible accuracy, the centered connection of the rotor is provided in a torsionally resistant manner on the shaft and can be supplemented by a form-locking profiled-shaft, a profiled-hub, an adjusting-spring, or a conical or wedged-groove connection. A form-locking connection is one which connects two elements together due to the shape of the elements themselves, as opposed to a force-locking connection, which locks the elements together by force external to the elements.

Other features which are considered as characteristic for the invention are set forth in the appended claims.

Although the invention is illustrated and described herein as embodied in a drive device for a front-loading washing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
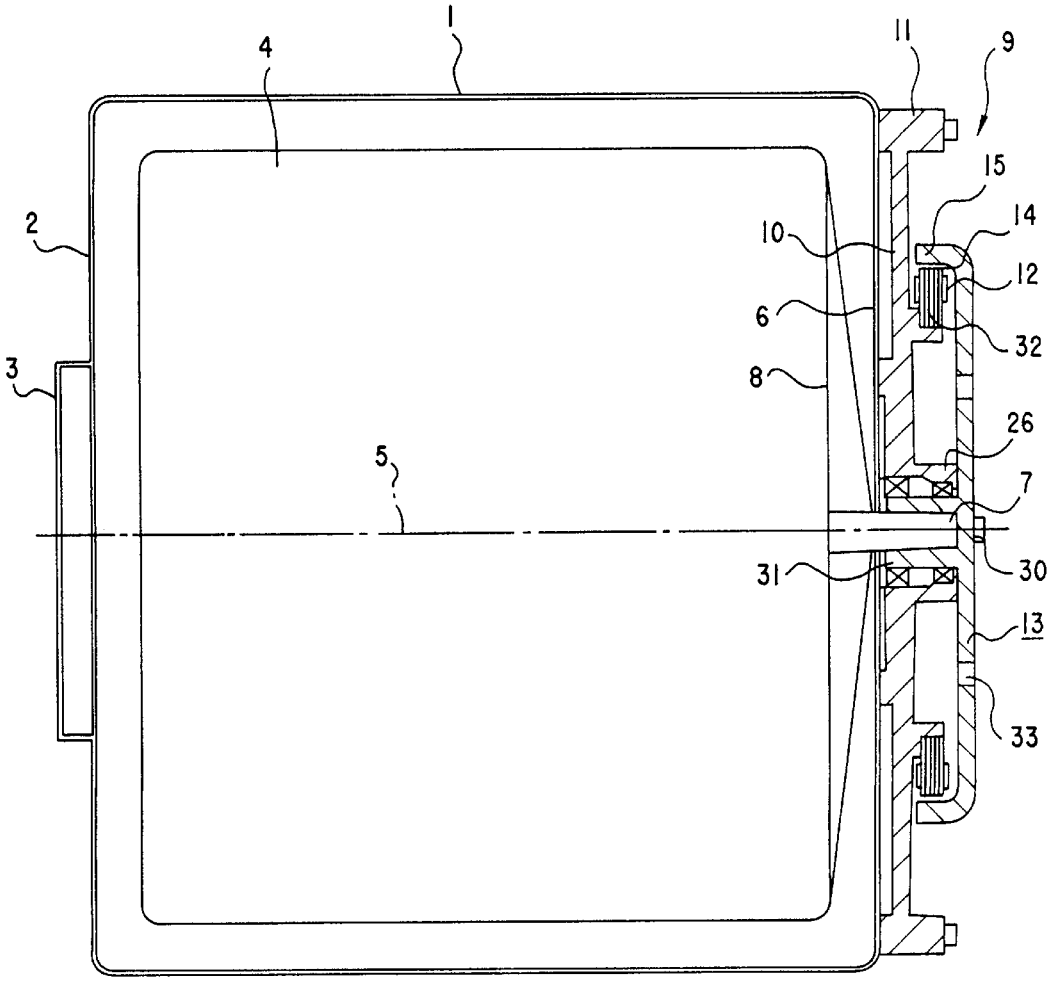
FIG 1 is a diagrammatic, partly-sectional view of a washing machine tub with a laundry drum which is mounted horizontally on the inside and has a drive shaft that is mounted together with a hub of a rotor bell in a bearing sleeve of a motor stator.

Referring now in detail to the single FIGURE of the drawing, there is seen a tub 1 which is mounted in such a way that it can oscillate in a non-illustrated housing of a washing machine, in a manner which is likewise not illustrated. The tub 1 has a front wall 2 with an opening 3 for loading and unloading a laundry drum 4, which is mounted in a rear wall 6 of the tub 1 in such a way that it can rotate about a horizontally situated axis 5. A shaft 7 which is used for this purpose, is connected at a rear wall 8 of the laundry drum 4 in a torsionally resistant manner.

A motor 9 which is mounted on the rear wall 6 of the tub 1 has a stator supporting part 10 that is connected to the rear wall 6 in a torsionally resistant manner through a flange 11. An outer periphery of the stator supporting part 10 carries a plurality of fastening lugs, preferably three, which are disposed in such a way that they are distributed around an periphery of the tub 1 and are fixedly connected to the tub through the use of screws. The stator supporting part 10 is additionally screwed to the rear wall 6 of the tub 1 through a mounting flange, in a manner that is not illustrated in detail herein.

A plurality of stator windings 12 with laminate stocks 32 are distributed on a rear surface of the stator supporting part 10 and are located opposite an inner surface of a bell flange 15 of a rotor 13, separated by a narrow air gap 14. A magnetic return flux of the bell flange 15 is automatically given by the annular shape thereof. The motor can therefore introduce its driving torques into the laundry drum 4 directly through a journal of the shaft 7. In this case, the stator 10 of the motor also absorbs all of the bearing forces, just like a supporting bracket that it replaces.

Figure 3:
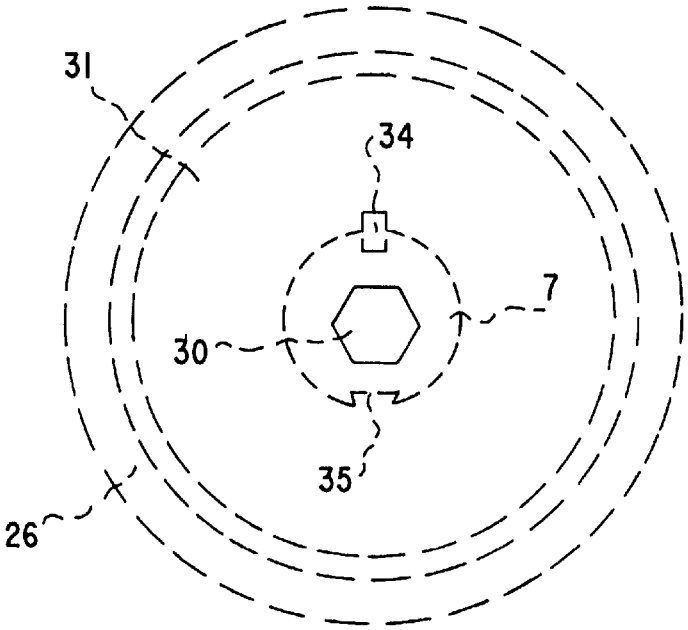
FIG. 3 is an enlarged rear elevational view of the center region of the bell flange shown in FIG. 2.

A bearing sleeve 26 of the stator supporting part 10 forms bearing seats for rolling bearings having inner races which are placed with a good fit on to the journal of the shaft 7 of the laundry drum 4. An outer end of the shaft 7 has a conical shape and is inserted into a conical hub 31 of the rotor 13 and is secured through the use of a central screw 30, with the result that it connects the rotor 13 through the hub 31 thereof and the inner races of the rolling bearings through the use of a cone connection to the laundry drum 4 in a torsionally resistant manner. The central connection of the rotor 13 on the shaft 7 can also be a torsionally resistant form-locking connection having an adjusting-spring 34 and/or a wedged-groove 35 as shown in FIG. 3.

Figure 2:
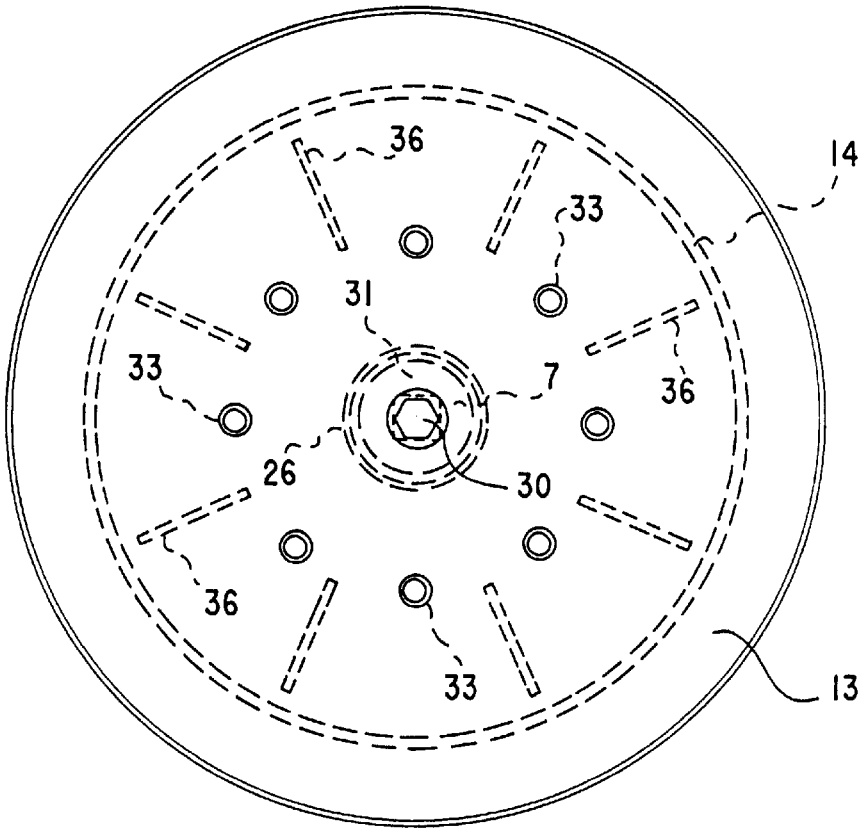
FIG. 2 is a rear elevational view of a bell flange.

The rotor or rotor disk 13 is equipped with perforations 33 for better ventilation and cooling of stator poles between its hub 26 and the bell flange 15. These perforations may advantageously define edges formed in such a way that the access of cooling air through these perforations is reinforced in the sense of a fan effect. In order to improve the cooling effect, so-called vortex generators 36 may also be fitted to the perforations or in the vicinity thereof as shown in FIG. 2. These vortex generators ensure vortexing of the cooling air in order to cause the latter to make better contact with the stator windings.

In this case the motor is constructed as an electronically commutated DC motor. Alternatively, it may be implemented as a so-called switched reluctance motor. In that case, at least the flange of the rotor and/or its inner support is composed of a material which is a relatively poor conductor in ferromagnetic terms. The structure of the stator is comparable with that of an electronically commutated DC motor. The particular advantage of the reluctance motor resides in a more cost-effective configuration of the rotor (no expensive magnetic materials).

In order to improve protection against rotation between the rotor 13 and the shaft 7, the screw connection 30 of the rotor 13 on the shaft 7 can be supplemented in a form-locking manner by a non-illustrated profiled shaft, profiled hub, adjusting spring, conical or wedged groove connection.

I claim:

1. In a front-loading washing machine including a tub having a rear wall, an at least approximately horizontally disposed shaft having an outer end, a laundry drum mounted overhung on the shaft, and a rigid supporting part fitted to the rear wall, a drive device for the washing machine, comprising:

a flat-type motor fitted to the rear wall of the tub for directly driving the shaft, said motor having a rotor formed entirely of magnetizable steel, and said motor having a stator connected on the rigid supporting part;

said rotor having a hub encompassing and centrally fastened on the outer end of the shaft, a peripheral part, a multiplicity of openings between said hub and said peripheral part, and a bell-like flange on said peripheral part pointing toward the tub;

said stator having a central bearing sleeve for the shaft and for said hub, and said stator having exciter windings; and laminate stacks distributed on said stator for receiving said exciter windings, said laminate stacks outwardly opposed by said bell-shaped flange defining an air gap.

2. The drive device according to claim 1, wherein said rotor has parts assisting in an air movement arising in the course of a rotary movement of said rotor.

3. The drive device according to claim 1, wherein said motor is an electronically commutated DC motor.

4. The drive device according to claim 1, wherein said motor is a switched reluctance motor.

5. The drive device according to claim 1, wherein the shaft is profiled, and said central connection of said rotor on the shaft is a torsionally resistant form-locking connection.

6. The drive device according to claim 1, wherein said hub is profiled, and said central connection of said rotor on the shaft is a torsionally resistant form-locking connection.

7. The drive device according to claim 1, wherein said central connection of said rotor on the shaft is a torsionally resistant form-locking connection having an adjusting-spring.

8. The drive device according to claim 1, wherein said central connection of said rotor on the shaft is a conical, torsionally resistant form-locking connection.

9. The drive device according to claim 1, wherein said central connection of said rotor on the shaft is a wedged-groove, torsionally resistant form-locking connection.

10. In a front-loading washing machine including a tub having a rear wall, an at least approximately horizontally disposed shaft having an outer end, and a laundry drum mounted overhung on the shaft, a drive device for the washing machine, comprising:

a flat-type motor fitted to the rear wall of the tub for directly driving the shaft, said motor having a rotor formed entirely of magnetizable steel, and said motor having a stator connected to the rear wall of the tub;

said rotor having a hub encompassing and centrally fastened on the outer end of the shaft, a peripheral part, a multiplicity of openings between said hub and said peripheral part, and a bell-like flange on said peripheral part pointing toward the tub;

said stator having a central bearing sleeve for the shaft and for said hub, and said stator having exciter windings; and laminate stacks distributed on said stator for receiving said exciter windings, said laminate stacks outwardly opposed by said bell-shaped flange defining an air gap.

11. The drive device according to claim 10, wherein said rotor has parts assisting in an air movement arising in the course of a rotary movement of said rotor.

12. The drive device according to claim 10, wherein said motor is an electronically commutated DC motor.

13. The drive device according to claim 10, wherein said motor is a switched reluctance motor.

14. The drive device according to claim 10, wherein the shaft is profiled, and said central connection of said rotor on the shaft is a torsionally resistant form-locking connection.

15. The drive device according to claim 10, wherein said hub is profiled, and said central connection of said rotor on the shaft is a torsionally resistant form-locking connection.

16. The drive device according to claim 10, wherein said central connection of said rotor on the shaft is a torsionally resistant form-locking connection having an adjusting-spring.

17. The drive device according to claim 10, wherein said central connection of said rotor on the shaft is a conical, torsionally resistant form-locking connection.

18. The drive device according to claim 10, wherein said central connection of said rotor on the shaft s a wedged-groove, torsionally resistant form-locking connection.

* * * * *